US005165150A

United States Patent [19]

van Riesen

[11] Patent Number: 5,165,150

[45] Date of Patent: Nov. 24, 1992

[54] BELT LOCK FOR BELT RETAINING SYSTEMS

[76] Inventor: Reiner van Riesen, Besenheide 36, 2200 Elmshorn, Fed. Rep. of Germany

[21] Appl. No.: 761,930

[22] PCT Filed: Jan. 22, 1991

[86] PCT No.: PCT/DE91/00068

§ 371 Date: Sep. 16, 1991

§ 102(e) Date: Sep. 16, 1991

[87] PCT Pub. No.: WO91/11125

PCT Pub. Date: Aug. 8, 1991

[30] Foreign Application Priority Data

Jan. 25, 1990 [DE] Fed. Rep. of Germany ..... 4002064

[51] Int. Cl.[5] ..... A44B 11/25

[52] U.S. Cl. ..... 24/641; 24/633

[58] Field of Search ..... 24/641, 633, 634, 635, 24/636, 637, 642, 643, 644, 640, 652, 653

[56] References Cited

U.S. PATENT DOCUMENTS

| | | | |
|---|---|---|---|
| 4,384,391 | 5/1983 | Lindblad et al. | 24/633 |
| 4,451,958 | 6/1984 | Robben et al. | 24/636 |
| 4,597,141 | 7/1986 | Wier | 24/633 |
| 4,642,858 | 2/1987 | Ishiguro et al. | 24/641 |
| 4,870,726 | 10/1989 | Eksell et al. | 24/641 |
| 4,920,620 | 5/1990 | Yamamoto et al. | 24/641 |
| 5,067,211 | 11/1991 | van Riesen | 24/641 |

FOREIGN PATENT DOCUMENTS 2199613 7/1988 United Kingdom .

*Primary Examiner*—Victor N. Sakran

*Attorney, Agent, or Firm*—Dvorak and Traub

[57] ABSTRACT

The belt lock comprises a closure mechanism and at least one belt strap end piece (2) which can be inserted into the mechanism, the belt strap end piece having a tongue (4) designed to lock with the mechanism. The mechanism has a metal frame (7), an arresting element (8) mounted in recesses (18) in the sides of the frame, an ejector (9) for the tongue, an arresting element support (10) and a belt-release button (11). In order to simplify the belt lock, reduce its manufacturing costs and increase its reliability, the arresting element (8) is designed as a plate with a rear recess (28) and the recesses (18) in the sides of the metal frame are designed as slots in which the arresting element (8) can be mounted. The slots extend parallel to the direction of motion of the tongue (4) in the frame (7) and their size is such that the pins (19) of the element (8) are guided to move in the direction of motion of the tongue (4) substantially without any play at right angles to this direction. The cross-piece part (22) of the frame (7) has a stop (24) which defines the stop location of the arresting element (8), and the arresting element support (10) is located behind the arresting element and above the ejector (9) and can move at least substantially parallel to the direction of motion of the ejector (9).

3 Claims, 2 Drawing Sheets

BELT LOCK FOR BELT RETAINING SYSTEMS

Figure 1:
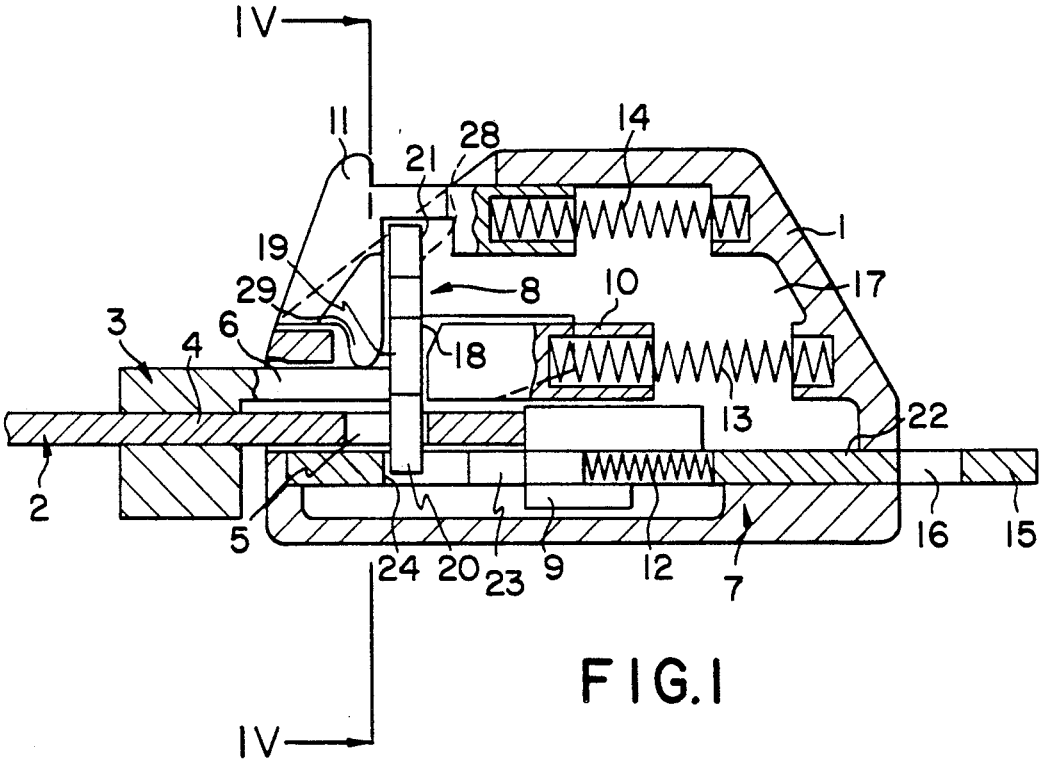

The invention proceeds from a belt lock for belt retaining systems, comprising a closure mechanism and at least one belt strap end piece which is able to be inserted therein, in which a tongue, which is able to be locked with the closure mechanism, and a control member are provided, and in which the closure mechanism consists of a U-shaped metal frame with lateral recesses, in which a plate-shaped arresting element serving to lock the tongue of the end piece is mounted by means of pins, and in which the closure mechanism further comprises a spring-loaded ejector which comes into operative connection with the tongue, a spring-loaded arresting element support to secure at least the closed position of the arresting element and also a spring-loaded release button.

Such a belt lock is described in the EP 25 24 403. In this belt lock, an arresting element is used which must be manufactured very precisely to ensure that it constantly functions without problems, and which is thereby costly, which is further increased through the complicated three-dimensional design. In addition, the tensional forces of the belt act on the locking part of the arresting element as bending forces, which makes a construction of the arresting element with a corresponding bending cross-section necessary, and makes this therefore relatively bulky.

A belt lock of the above-mentioned type, likewise of very complicated construction, can also be seen from the EP-A-83 752.

It is an object of the invention to improve the belt lock of the type indicated in the introduction such that with a simple construction it is able to be produced at a more favourable cost and is able to be operated more easily and also operates without problems.

This problem is solved according to the invention through the features of Claim 1.

Through this solution, the arresting element is further simplified in its shape. It is able to be produced through a single punching process and requires no bending steps for further fashioning. Its smaller overall size, caused thereby, leads to a smaller mass with the advantage that this element, consisting of metal, now requires less operating forces. The latter is also because in its closing and opening operation, it is exposed to smaller frictional forces, especially since in accordance with the invention it is in principle mounted with a relative large play in the slots. However, in every case a secure stop position of the arresting element is achieved, because on the one hand it is not movable in transverse direction to the longitudinal extent of the lateral slots, at least in the stop position. The tensional forces of the belt are taken up on both sides of their point of application on the arresting element, which makes possible a non-bulky construction of the arresting element and correspondingly easy operability.

Furthermore, a reliable opening of the belt lock is achieved in that the arresting element located in the locking position, through actuation of the release button with a pushing back of the arresting element support, is firstly able to be brought into an inclined position and then further, on emergence of the tongue, is able to be brought into a position substantially parallel to the direction of movement thereof.

Figure 2:
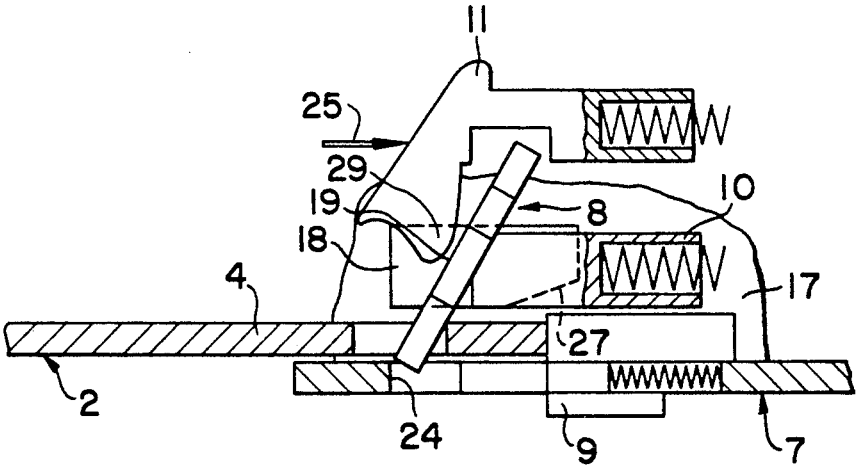
Figure 3:
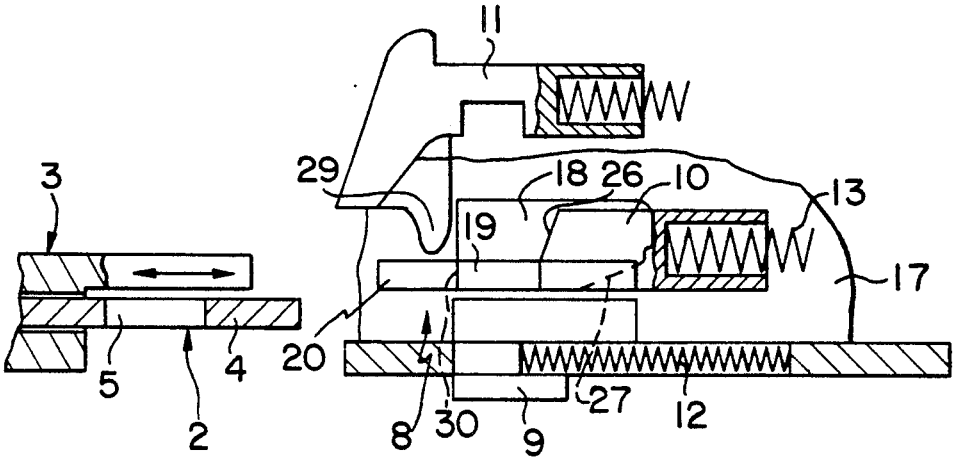
Figure 4:
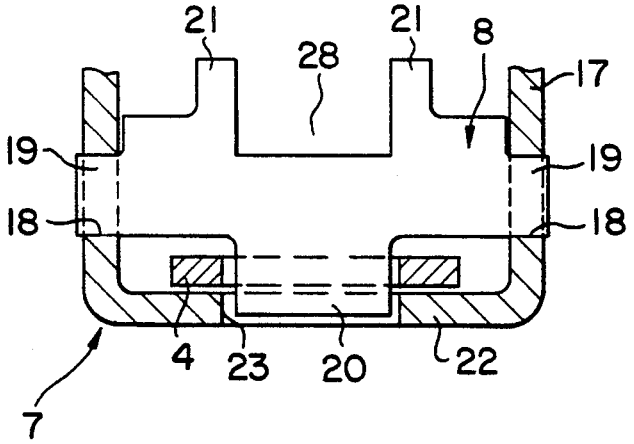

The invention is explained in further detail hereinbelow with the aid of an example embodiment illustrated in the drawing, in which:

FIG. 1 shows a longitudinal section through the belt lock in closed position, FIG. 2 shows an illustration of the closure mechanism of the lock according to FIG. 1 in an intermediate position on actuation of the release button, FIG. 3 shows the closure mechanism after the completed actuation of the release button, FIG. 4 shows a simplified partial section along the section line IV—IV in FIG. 1.

According to FIGS. 1 to 3, the belt lock consists substantially of a lock housing 1, with a closure mechanism situated therein, and of two belt strap end pieces 2 and 3, which are shown in partial representation. The end piece 2 has a tongue 4 with a locking slot 5, whilst the other end piece 3 has a control member 6. A single belt strap end piece may also be used, which then also has the control member 6. It is also possible to use more than two end pieces. The end pieces 2, 3 engage into each other (FIG. 1).

The mechanism which is used comprises a U-shaped metal frame 7, an arresting element 8 mounted therein to lock the tongue 4, a conventional ejector 9, loaded by a compression spring, for the unlocked tongue, an arresting element support 10, and a release button 11, loaded by a compression spring, which release button engages above on the arresting element and preferably is movable parallel to the direction of movement of the tongue 4. For the parts 9, 10 and 11 preferably a compression spring 12, 13 and 14 is used. The cross-piece part of the metal frame 7 has a rear extension 15 with a hole 16, on which, in a known manner, a belt strap (not shown) is attached.

The two shanks 17 of the U-shaped metal frame 7 which lie opposite each other (FIG. 4) each have a substantially rectangular recess 18 to hold and guide the arresting element 8, which are arranged such that the two recesses 18 extend parallel to the direction of movement of the tongue 4 in the mechanism and each are provided in such a region of the shanks 17 which lies slightly above the locking slot 5 of the tongue 4, when the latter is engaged in the mechanism.

The arresting element 8, as can be seen from FIG. 4, is a plate-shaped, substantially rectangular and flat shaped part of sheet metal, which on its short sides is provided in each case with a pin 19 of substantially rectangular cross-section. The pins 19 engage into the recesses 18, whereby the arresting element 8 is held and guided in the metal frame 7 (FIG. 4). The arresting element 8 further has at its lower end an arresting nose 20, coming into engagement with the locking slot 5, and also on its upper end noses 21 engaging into the release button 11.

The width of the pins 19 corresponds substantially to the height of the recess 18, so that the arresting element 8, when it stands vertically, as shown in FIGS. 1 and 4, can not move in vertical direction, in this respect is therefore fixed. In longitudinal direction of the recesses 18, however, the pins 19 can move, and namely owing to the length of the recesses 18, which is several times greater in relation to the thickness of the pins 19.

The metal frame 7, in its cross-piece part 22 connecting the two shanks 17, has a conventional, elongated guide recess 23 to receive and axially guide the ejector 9 of known construction, which in connection with the compression spring 12 ejects the tongue 4 of the end piece 2 when the arresting element 8 is unlocked. The front end of the recess 23, which is formed as a punched hole, also at the same time serves as a stop 24 for the arresting nose 20 of the arresting element 8, when the latter is engaged (FIG. 1), so that also thereby the stop position of the arresting element 8 is secured.

The arresting element support 10 is arranged above the ejector 9 and behind the arresting element 8, and namely so as to be axially movable substantially parallel to the cross-piece part 22 of the metal frame 7. Here, the arresting element support 10 is supported against the insertion direction of the tongue 4 by the compression spring 13. The contact surface of the arresting element support 10 on the arresting element 8 is provided with an inclination 26 (FIG. 3). The arresting element support 10 is mounted so as to be guided in a suitable manner in the lock housing 1.

The arresting element support 10 has a height measurement which corresponds substantially to that of the recesses 18 in the shanks 17 of the metal frame 7. In addition, the lower longitudinal edge of the recesses 18 is provided with a ramp 27 reducing the height thereof in the insertion direction of the tongue 4.

In a further embodiment of the arresting element 8, the latter has a rear recess 28, i.e. provided in the marginal region lying opposite the arresting nose, which recess 28 is open toward the rear. The width of the recess corresponds to that of the arresting element support 10, so that this support, when the arresting element is in open position, can engage in the recess 28. Furthermore, the release button 11 is provided with actuating means 29, e.g. as shown with an inner and lower pressure member, in order to be able to automatically and reliably bring the arresting element 8 into its open position on opening the belt lock. The additional means (29) project downwards.

The described belt lock mechanism functions in the following manner:

To illustrate the manner of functioning, one will proceed firstly from FIG. 3, in which, however, the condition shown there after the opening and ejection of the tongue 4 is regarded as the starting condition for the closing process. In order to initiate this, the belt strap end pieces 2 and 3 (FIG. 1) are put together and the tongue 4 of the end piece 2 is inserted into the lock housing 1. Here, the tongue 4 firstly comes to rest along against the ejector 9 and pushes the latter back against the compression spring 12. After a certain pushing distance, the control member 6 lies against the front end of the arresting nose 20 of the arresting element 8 which is lying horizontally, and pushes the latter against the arresting element support 10, which under compression of the compression spring 13 supporting it likewise retreats. Here, the pins 19 of the arresting element 8 slide on the lower longitudinal edge of the recesses 18 and finally arrive at the ramps 27 with the effect that the arresting element 8 begins to right itself. When it has arrived at the end of the ramps 27, the arresting element 8 has reached a tilted position such that its rear side on the arresting element support 10 has arrived into the region of the inclination 26. At the same time, the arresting nose 20 is swung into the locking slot 5 of the tongue 4. Now the direction of movement of the arresting element support 10 reverses, because the compression spring 13 can expand, which brings it about that the arresting element is fully righted, because through the arresting element support 10 a moment of rotation acts on the arresting element 8, righting it. In this position of the arresting element 8, its noses 21 have come into engagement with the release button 11 and the arresting nose 20 is swung fully into the guide recess 23 in the cross-piece part 22 of the metal frame 7. The reverse shift of the arresting element support 10 brings it about that the pins of the arresting element 8 come to rest against the front delimiting edge of the recesses 18, and the arresting nose 20 against the stop 24 (FIG. 1). The tongue 4 is now locked with the lock housing 1.

For opening, the release button 11 (FIG. 2) is pressed in the direction of the arrow 25. This has the result that the arresting element 8 is tilted through engagement of the button on the noses 21 and through the pressure member 29. Here, the arresting element support 10 is pushed back, because the arresting nose 20 rests against the stop 24. Owing to the guidance and support of the pins 19 in the recesses 18, through the increasing tilting of the arresting element 8 its arresting nose 20 withdraws out of the guide recess 23 and finally loses its hold on the stop 24. At this moment, the tongue 4 is pushed out of the lock housing 1 by the ejector 9 owing to the tensional force of the compression spring 12. Thereby, the arresting element 8, which firstly still sits with its arresting nose 20 in the locking slot 5 of the tongue 4, is further tilted and entrained, until its bearing pins 19 rest against the front delimiting edge of the recesses 18. Here, the pressure element 29 of the release button cooperates and finally brings the arresting element 8 into its horizontal open position, in which the arresting element support 10 engages into the recess 28 of the arresting element and holds the latter clamped in the open position by means of its spring 13.

In order to arrange this latter process so as to be even safer, the front delimiting edge of each of the two recesses 18 can be provided in its lower region with a depression 30 (indicated in dashed lines in FIG. 3), in which the bearing pins 19 can rest so that a displacement of the arresting element 8 upwards is not possible.

The displacement of the arresting element support 10 brought about by tilting the arresting element 8 into the horizontal position, and the compression of the compression spring 13 taking place thereby has the result that the horizontal position of the arresting element 8 is fixed in a sufficient manner.

I claim:

1. A belt lock for belt retaining systems, comprising a closure mechanism and at least one belt strap end piece (2) able to be inserted therein, in which a tongue (4) which is able to be locked with the closure mechanism, and a control member are provided and in which the closure mechanism consists of a metal frame (7) with lateral recesses (18), in which an arresting element (8), serving to lock the tongue, is mounted by means of pins (19), and in which the closure mechanism additionally comprises a spring loaded ejector (9), coming into operative connection with the tongue (4), a spring-loaded arresting element support (10) to secure at least the closed position of the arresting element (8) and also a spring-loaded release button (11), characterised in that the arresting element (8) is a flat plate component, which has a rear, open recess (28), each of the lateral recesses (18) in the metal frame (7) to hold and guide the pins (19) of the arresting element (8) has the shape of an oblong hole which extends adjacent to the path of the tongue (4) and the longitudinal axis of which runs substantially parallel to the direction of movement of the tongue (4), the lower delimiting edge of each recess (18), viewed in the direction of insertion of the tongue (4), continues into a ramp (27), the recess (18) and pins (19) are dimensioned such that the latter are guided in the direction of movement of the tongue (4) in the locking position of the arresting element (8) in the recesses (18) so as to be movable but free from play vertically thereto, the cross-piece part (22) of the metal frame (7) has a stop (24) for the fixing of the arresting element (8) in the closed position, and the release button (11) is provided with actuating means (29) for the arresting element.

2. A belt lock according to claim 1, characterised in that the rear recess (28) of the arresting element (8), for the engagement of the arresting element support (10), is constructed therein.

3. A belt lock according to claim 1, characterised in that both lateral recesses (18) each have a depression (30) in the front at their bottom.

* * * * *